US009492703B1

(12) United States Patent
Lechuga

(10) Patent No.: US 9,492,703 B1
(45) Date of Patent: Nov. 15, 2016

(54) ONE PIECE EXERCISE WEIGHT PLATE

(71) Applicant: Carlos Guzman Lechuga, Artesia, CA (US)

(72) Inventor: Carlos Guzman Lechuga, Artesia, CA (US)

( * ) Notice: Subject to any disclaimer, the term of this patent is extended or adjusted under 35 U.S.C. 154(b) by 0 days.

(21) Appl. No.: 14/218,884

(22) Filed: Mar. 18, 2014

Related U.S. Application Data

(60) Provisional application No. 61/852,658, filed on Mar. 19, 2013.

(51) Int. Cl.
*A63B 21/062* (2006.01)
*A63B 21/072* (2006.01)

(52) U.S. Cl.
CPC ..... *A63B 21/4043* (2015.10); *A63B 21/072* (2013.01); *A63B 21/4035* (2015.10)

(58) Field of Classification Search
CPC A63B 21/06; A63B 21/072; A63B 21/0724; A63B 21/0726; A63B 21/075
USPC ..... D21/680, 681
See application file for complete search history.

(56) References Cited

U.S. PATENT DOCUMENTS

D354,322 S * 1/1995 Vodhanel, Jr. ..... D21/681
D483,083 S * 12/2003 Allshouse ..... D21/680
6,893,385 B2 * 5/2005 Smithberg ..... A63B 71/0054 482/107
6,991,590 B2 * 1/2006 Vigiano ..... A63B 21/06 482/106
7,828,702 B2 * 11/2010 Lien ..... A63B 21/0724 482/106
2003/0083179 A1 * 5/2003 Landfair ..... A63B 21/06 482/93

* cited by examiner

*Primary Examiner* — Oren Ginsberg

(57) ABSTRACT

The embodiment which has been labeled "one piece exercise weight plate 90" and is shown in renderings attached labeled as FIG. 1, FIG. 2 and FIG. 3 is a piece of exercise equipment that has the ability to be manipulated to perform exercise movements and motions that other equipment does not offer. This piece of exercise equipment is one whole piece and large enough in span to create an agreeable sense of control and balance with its intended user to perform exercises that complement the human bodies range of motion amongst its extremities.

Figure 1:
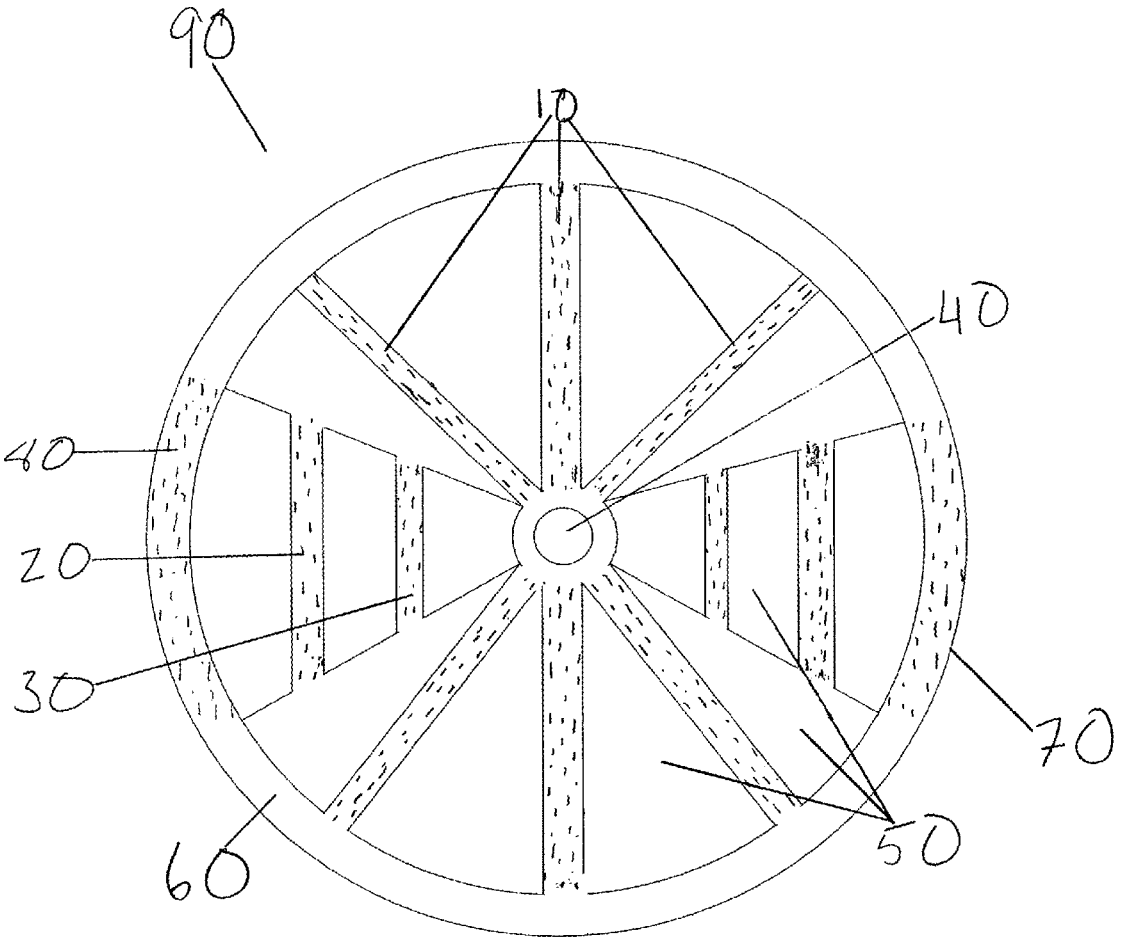

This embodiment is rigid in structure and circular in circumference. The embodiment will vary in weight to accommodate a user's desire for resistance and use. This piece is solid and will be able to be held and used by gripping, pressing, pulling or performing any other type of physical movement with relation to the characteristics/attributes described in the drawings accompanied in FIGS. 1, 2 and 3. The advantages from other exercise pieces of equipment is that the embodiment is complimentary of the body's range of motion among performing physical exercise or therapeutic acts by utilizing its various grips, surface areas, symmetrical balanced weight and larger than common olympic weight plate size (for weight ratio). Note that FIGS. 1, 2, and 3 denote the subject matter described in the accompanying Title/Features/Relationships/Description/Operation/Benefits page.

1 Claim, 3 Drawing Sheets

FRONT VIEW

FRONT VIEW

FRONT 3D VIEW

SIDE 3D VIEW

ONE PIECE EXERCISE WEIGHT PLATE

FEATURES

There is a flat surface 60 which is identical on either side of the cylindrical plate. Center circular void/hole 40 runs through cylindrical plate so that similar sized object can go through plate (i.e. corresponding exercise equipment). Hand grips 10, 20, 30, 80 for right/left hand have corresponding hand grip for opposite hand on opposite side of center whole 40. 80 is part of surface 60 but also used and engineered for hand grip(s). There are empty cut-outs 50 on flat surface matter of one piece cylindrical plate for space between hand grips and space between hand grips and solid plate area/surface. Hand grips 80 are on and over edge of flat plate surface which provides continuous grip through full spherical dimension of grip 80.

RELATIONSHIPS

Surface 60 has hand grips 10, 20, 30, 80 incorporated into its structure. Spaces 50 are in between hand grips and are used to separate surface area functions of cylindrical plate. 40 lies in horizontal and vertical center of cylindrical plate surface. 80 is on and over part of edge of surface 60 along circular edge. Surface 60 ends at edge 70 of cylindrical plate.

DESCRIPTION

FIG. 1 reflects a surface view of the following items: 10, 20, 30, 40, 50, 60, 70, 80 and 90. These are items will be described as follows: Weight plate 90 may be made from solid piece of metal or plastic or rubber. Hand grips and spacing may be cut out, machined out or routed out to give appropriate hand grips, spacing and structural surface. Hand grips are in place for purposes of individuals performing exercise movements. Hand grips 80 lie on and over edge of surface for outer-most hand grips. All hand grips have corresponding hand grips on opposite side of weight plate for concurrent use with opposite hand. Hand grips 20, 30 and 80 have corresponding hand grip on opposite side of circular empty space 40. Hand grips 10 also have opposing hand grip on direct opposite side of circular empty space 40. These hand grips consist of a non-smooth surface so plate movement can be facilitated by easier handling. 40 lies in perfect center of circular surface 60 so that weight distribution of this plate is balanced when mounted through this area to other equipment. Edge of plate 70 has plate depth 100 approximately ranging from 0.5"-16.0" (inches). The large size of plate is dissimilar to size of common weights of similar weight (lbs./kilos.) as it is much larger to accommodate for benefit of easier grip, stability and versatility when user performs exercise movements.

Figure 2:
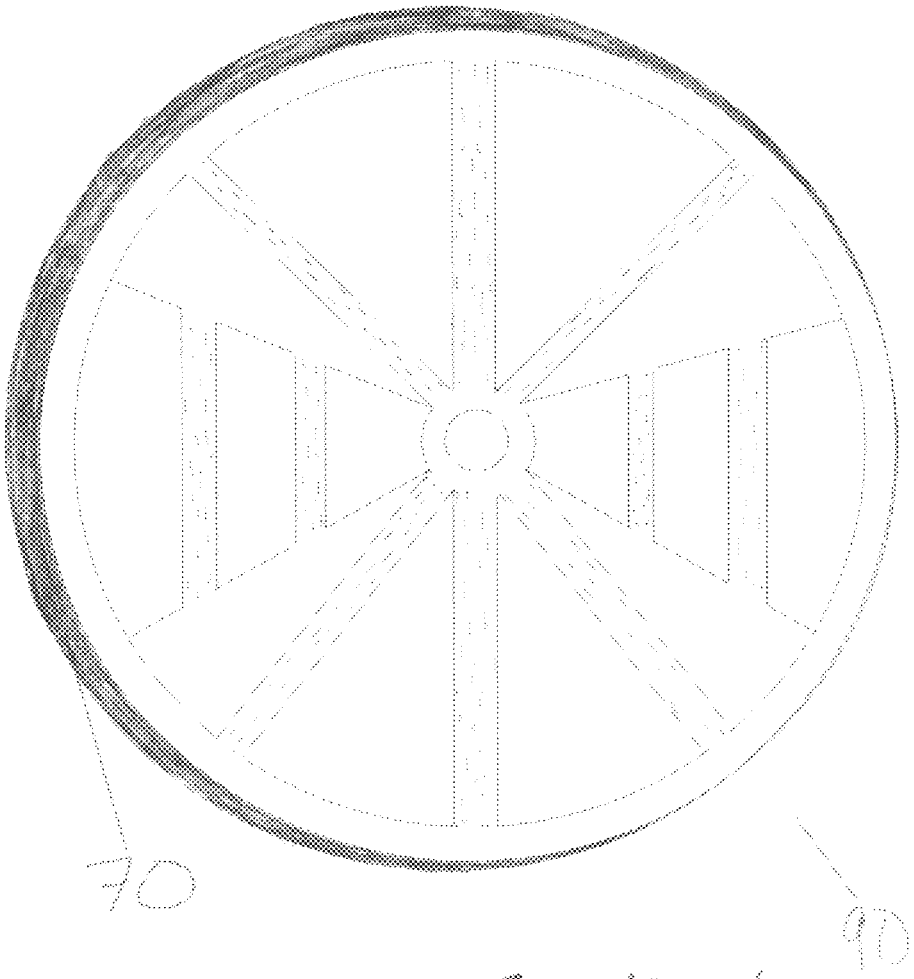
Figure 3:
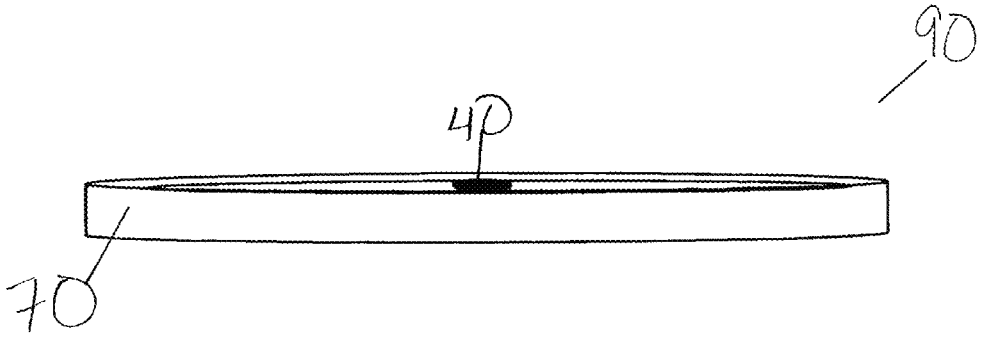

Note that FIG. 2 has a three dimensional view of FIG. 1 showing the disc-like dimension of the embodiment. FIG. 3 further shows a side view of the embodiment reflecting the flat outline of the shape. These figures all reflect non-protruding characteristics.

OPERATION

When weight plate 90 is held on grips 10, 20, 30, 80, with complimenting hand grip on opposite side, exercise movements may be performed (i.e. arm curls, presses, extensions and pulls). Exercise movements can also be performed by singular grip. Empty circular area 40 allow for weight plate to be used to allow for mounting on other exercise equipment.

BENEFITS

Weight plate is a one-piece, multi-use, compact piece of exercise equipment. Multiple hand grips 10, 20, 30, 80 allow for diverse usage in performing exercise acts/movements. Circular empty space 40 allows for use on other exercise equipment if user desires.

The invention claimed is:

1. A one piece exercise weight plate consisting of:

a circular weight plate body;

a first flat surface formed on one side of the circular weight plate body;

a second flat surface formed on another side of the circular weight plate body, wherein the second flat surface is opposed to the first flat surface;

a circular hole that runs through the circular weight plate body wherein the circular hole is formed in the center of both the first and second flat surfaces, the circular hole is configured to receive exercise equipment therein; and each side of the circular weight plate body further consisting of:

a first set of six handles, wherein a longitudinal axis of each handle of the first set of six handles extends from a periphery of the respective side of the circular weight plate body to the circular hole;

a second set of six handles, wherein a longitudinal axis of each handle of the second set of six handles is radially offset from the circular hole; and wherein a gripping surface of each handle of the first set of six handles and the second set of six handles is non-smooth.

* * * * *